US011805870B2

(12) United States Patent
Zheng

(10) Patent No.: US 11,805,870 B2
(45) Date of Patent: Nov. 7, 2023

(54) ARTICLE OF HARD LUGGAGE WITH AN EXTERIOR POCKET

(71) Applicant: IT LUGGAGE LIMITED, Hertford (GB)

(72) Inventor: Min Zheng, Zhejiang (CN)

(73) Assignee: it Luggage Limited, Hertford (GB)

( * ) Notice: Subject to any disclaimer, the term of this patent is extended or adjusted under 35 U.S.C. 154(b) by 154 days.

(21) Appl. No.: 17/423,977

(22) PCT Filed: Nov. 29, 2019

(86) PCT No.: PCT/EP2019/083083
§ 371 (c)(1),
(2) Date: Jul. 19, 2021

(87) PCT Pub. No.: WO2020/151858
PCT Pub. Date: Jul. 30, 2020

(65) Prior Publication Data

US 2022/0087382 A1 Mar. 24, 2022

(30) Foreign Application Priority Data

Jan. 22, 2019 (GB) ..... 1900869

(51) Int. Cl.
*A45C 5/03* (2006.01)
*A45C 5/06* (2006.01)
(Continued)

(52) U.S. Cl.
CPC ..... *A45C 5/03* (2013.01); *A45C 5/06* (2013.01); *A45C 5/14* (2013.01); *A45C 13/103* (2013.01); *A45C 2005/037* (2013.01)

(58) Field of Classification Search
CPC .... A45C 5/03; A45C 5/06; A45C 5/14; A45C 13/103; A45C 2005/037
See application file for complete search history.

(56) References Cited

U.S. PATENT DOCUMENTS 5,252,161 A * 10/1993 Chang ..... A45C 5/02 190/125
6,793,051 B2 9/2004 Siwak
(Continued)

FOREIGN PATENT DOCUMENTS

CN 1489444 U 4/2004
CN 202445327 U 9/2012
(Continued)

OTHER PUBLICATIONS

International Preliminary Report on Patentability and Written Opinion of the International Searching Authority for International Patent Application No. PCT/EP2019/083083; dated Jul. 27, 2021 (7 pages).
(Continued)

*Primary Examiner* — Tri M Mai
(74) *Attorney, Agent, or Firm* — Barnes & Thornburg LLP

(57) ABSTRACT

An article of luggage comprises: a body in the form of a first moulded concave shell having an interior defining a body containment volume accessible through a body opening; and a lid in the form of a second moulded concave shell having an interior defining a lid containment volume accessible through a lid opening. The article of luggage further comprises a primary zip fastening comprising first and second zip tapes mutually connectable and disconnectable via a zip fastening slider, wherein the first zip tape is stitched to the lid around a perimeter of the lid opening and the second zip tape is stitched to the body around a perimeter of the body opening. The article of luggage further comprises: a hinge between the body and the lid to enable movement of the lid relative to the body between: an open position in which the body and lid containment volumes are accessible through the body and lid openings; and a closed position in which the body and the lid openings cooperate to enable fastening of the first zip tape to the second zip tape whereby the body and
(Continued)

lid containment portions are enclosed. The article of luggage further comprises: a fabric panel mounted on an exterior of the lid and stitched to the first zip tape, the fabric panel comprising a pocket having a pocket opening. Also disclosed is a method of manufacturing an article of luggage.

14 Claims, 7 Drawing Sheets

(51) Int. Cl.
*A45C 5/14* (2006.01)
*A45C 13/10* (2006.01)

(56) References Cited

U.S. PATENT DOCUMENTS 6,953,110 B2 * 10/2005 Santy ..... A45C 5/06 190/125
10,074,999 B2 9/2018 Watson
2008/0230338 A1 * 9/2008 Liang ..... A45C 13/28 206/286
2011/0297498 A1 * 12/2011 Yu ..... A45C 5/06 190/110
2016/0324300 A1 * 11/2016 Wronski ..... A45C 13/40
2021/0120925 A1 * 4/2021 De Vos ..... A45C 13/262

FOREIGN PATENT DOCUMENTS

CN 203692786 U 7/2014
CN 206744778 U 12/2017
KR 200450618 10/2010
WO WO2017079707 5/2017

OTHER PUBLICATIONS

Communication under Rule 71(3) EPC for European Patent Application No. 19813299.5; dated Nov. 3, 2020 (30 pages).
PCT Search Report and Written Opinion prepared for PCT/EP2019/083083, completed Jan. 31, 2020.
United Kingdom Examination Report prepared for 1900869.7, completed Jul. 12, 2019.
Search Report in Chinese for Chinese Patent Application No. 2019800899174 dated Dec. 16, 2022, and a partial English translation (3 pages).

* cited by examiner

ARTICLE OF HARD LUGGAGE WITH AN EXTERIOR POCKET

CROSS-REFERENCE TO RELATED APPLICATIONS

This application is the U.S. national phase of PCT/EP2019/083083, filed on Nov. 29, 2019, which claims the benefit of United Kingdom Patent Application Number 1900869.7, filed on Jan. 22, 2019, the entire disclosures of both of which are hereby incorporated by reference herein.

TECHNICAL FIELD

The disclosure relates to the field of hard luggage, such as suitcases, comprising rigid moulded shells.

BACKGROUND

One advantage of hard luggage relative to soft luggage is that it is more resistant to attempts to gain access to its contents.

Soft luggage is often formed of fabric panels and may be quickly and discretely cut with a knife in order to gain access to the luggage contents. By contrast, hard luggage is often formed rigid moulded shells and so is less vulnerable to such cutting with a knife or to other attempts at quick and discrete damage.

While hard luggage may provide for greater security than soft luggage, one consequence of the material properties that give rise to greater security is that manufacture of such luggage may be more complex. Hard luggage is usually formed from a pair of rigid, moulded shells, one body and one lid, that are mutually fastenable, often with a conventional heavy duty zip fastening. The zip fastening may comprise a first tape connected to the lid and a second tape connected to the body, wherein the first and second tapes are mutually connectable and disconnectable via a slider.

Attaching the first and second zip tapes to the moulded shells of the lid and body may require a specific stitching process which facilitates piercing of the rigid moulded material in order to stitch on the zip fastening tape.

On account of the rigid moulded nature of the hard luggage, it is not normal to provide a piece of hard luggage with an exterior pocket. Such pockets are much more common and straightforward to include on soft luggage, where stitching of additional fabric to provide for an exterior pocket may be straightforward. Exterior pockets may be particularly useful for storing travel documents to allow access without needing to open the main volume of the article of luggage.

SUMMARY OF THE DISCLOSURE

Against this background there is provided in a first aspect of the disclosure: an article of luggage comprising:

- a body in the form of a first moulded concave shell having an interior defining a body containment volume accessible through a body opening;
- a lid in the form of a second moulded concave shell having an interior defining a lid containment volume accessible through a lid opening;
- a primary zip fastening comprising first and second zip tapes mutually connectable and disconnectable via a zip fastening slider, wherein the first zip tape is stitched to the lid around a perimeter of the lid opening and the second zip tape is stitched to the body around a perimeter of the body opening;
- a hinge between the body and the lid to enable movement of the lid relative to the body between: an open position in which the body and lid containment volumes are accessible through the body and lid openings; and a closed position in which the body and the lid openings cooperate to enable fastening of the first zip tape to the second zip tape whereby the body and lid containment portions are enclosed; and a fabric panel mounted on an exterior of the lid and stitched to the first zip tape, the fabric panel comprising a pocket having a pocket opening.

Advantageously, therefore, it is possible to provide an item of hard luggage with an exterior pocket without requiring additional manufacturing steps that involve the hard shell components.

The fabric panel may comprise an inner fabric sheet and an outer fabric sheet fastened to the inner fabric sheet wherein the pocket comprises a volume between the inner and outer fabric sheets.

The fabric panel may be stitched to the first zip tape using a first line of stitching; and the first zip tape may be stitched to the lid using the first line of stitching.

The fabric panel may comprise first, second, third and fourth sides, wherein the first, second, third and fourth sides may be stitched to at least some of the first zip tape using the first line of stitching.

The fabric panel may be stitched to the first zip tape using a first line of stitching; and the first zip tape is stitched to the lid using a second line of stitching.

The fabric panel may comprise first, second, third and fourth sides, wherein the first, second, third and fourth sides may be stitched to at least some of the first zip tape using the second line of stitching.

The article of luggage may further comprise a pocket opening zip to facilitate opening and closing of the pocket opening.

The pocket opening may be linear.

The pocket opening may comprise a first linear portion and a second linear portion substantially right angles to the first linear portion.

The article of luggage may further comprise an expansion gusset having:

- an undeployed condition in which the body and lid openings are in relative close proximity such that an interior volume of the article of luggage is largely bounded by the body and the lid; and
- a deployed configuration in which the body and lid are spaced apart by the expansion guest to provide an expanded interior volume of the article of luggage.

The expansion gusset may comprise a fabric strip that forms a part of either the first or the second zip tape.

The expansion gusset may comprise a secondary zip fastening wherein the secondary zip fastening is closable to provide the undeployed configuration of the expansion gusset and is openable to provide the deployed configuration of the expansion gusset.

The article of luggage may be in the form of a suitcase.

In a second aspect of the disclosure there is provided: a method of manufacturing an article of luggage, the article of luggage comprising:

- a body in the form of a first moulded concave shell having an interior defining a body containment volume accessible through a body opening;

a lid in the form of a second moulded concave shell having an interior defining a lid containment volume accessible through a lid opening;

a primary zip fastening comprising first and second zip tapes mutually connectable and disconnectable via a zip fastening slider, a hinge between the body and the lid to enable movement of the lid relative to the body between: an open position in which the body and lid containment volumes are accessible through the body and lid openings; and a closed position in which the body and the lid openings cooperate to enable fastening of the first zip tape to the second zip tape whereby the body and lid containment portions are enclosed; and a fabric panel comprising a pocket having a pocket opening;

wherein the method comprises:

stitching the first zip tape to the lid around a perimeter of the lid opening;

stitching the second zip tape to the body around a perimeter of the body opening;

stitching the fabric panel to the primary zip fastening.

The step of stitching the fabric panel to the primary zip fastening and the step of stitching the first zip tape to the lid around a perimeter of the lid opening may be performed as a single stitching step.

DETAILED DESCRIPTION

Figure 1:
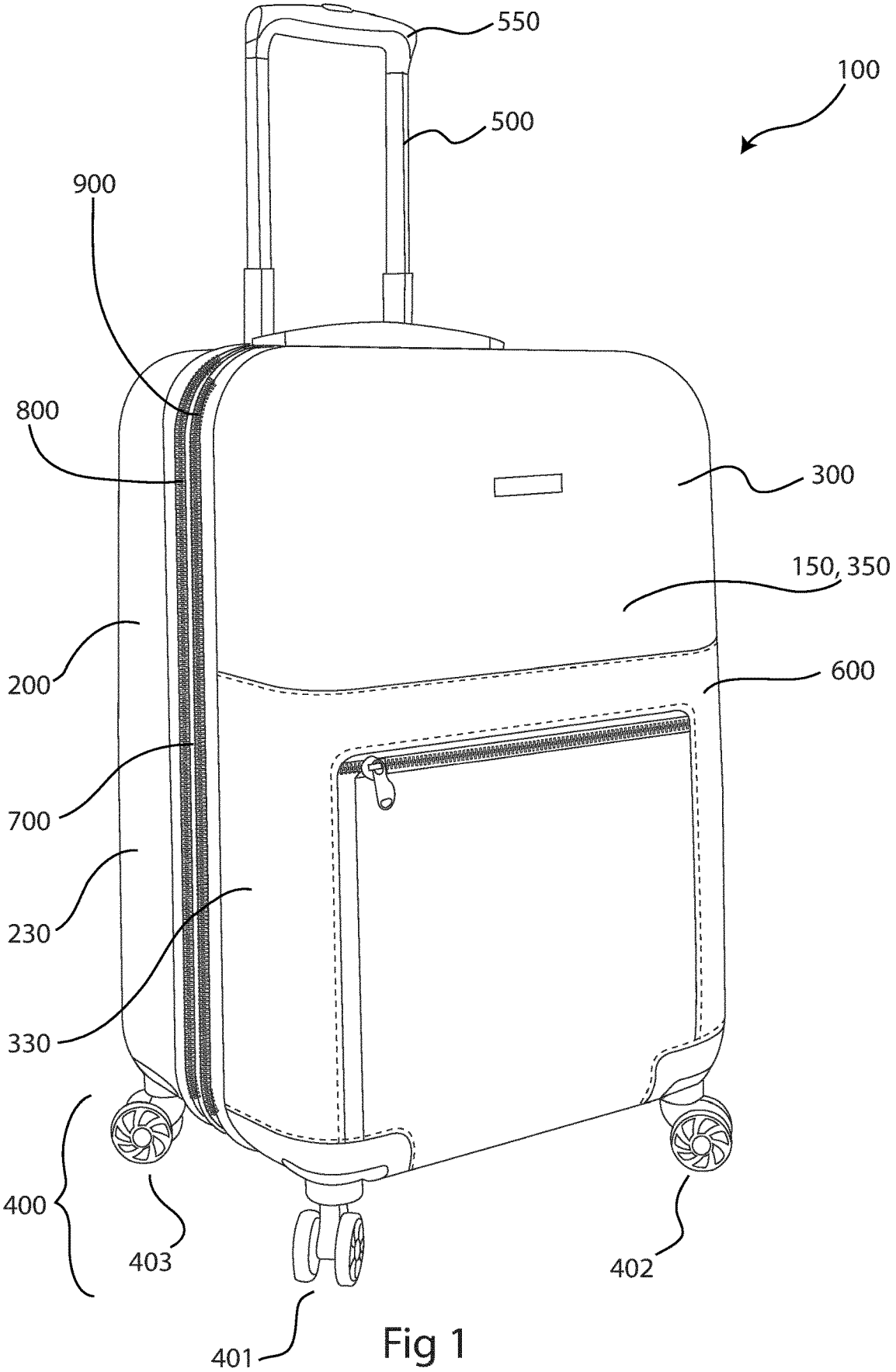
FIG. 1 shows a perspective view of a suitcase in accordance with an embodiment of the disclosure.
Figure 2:
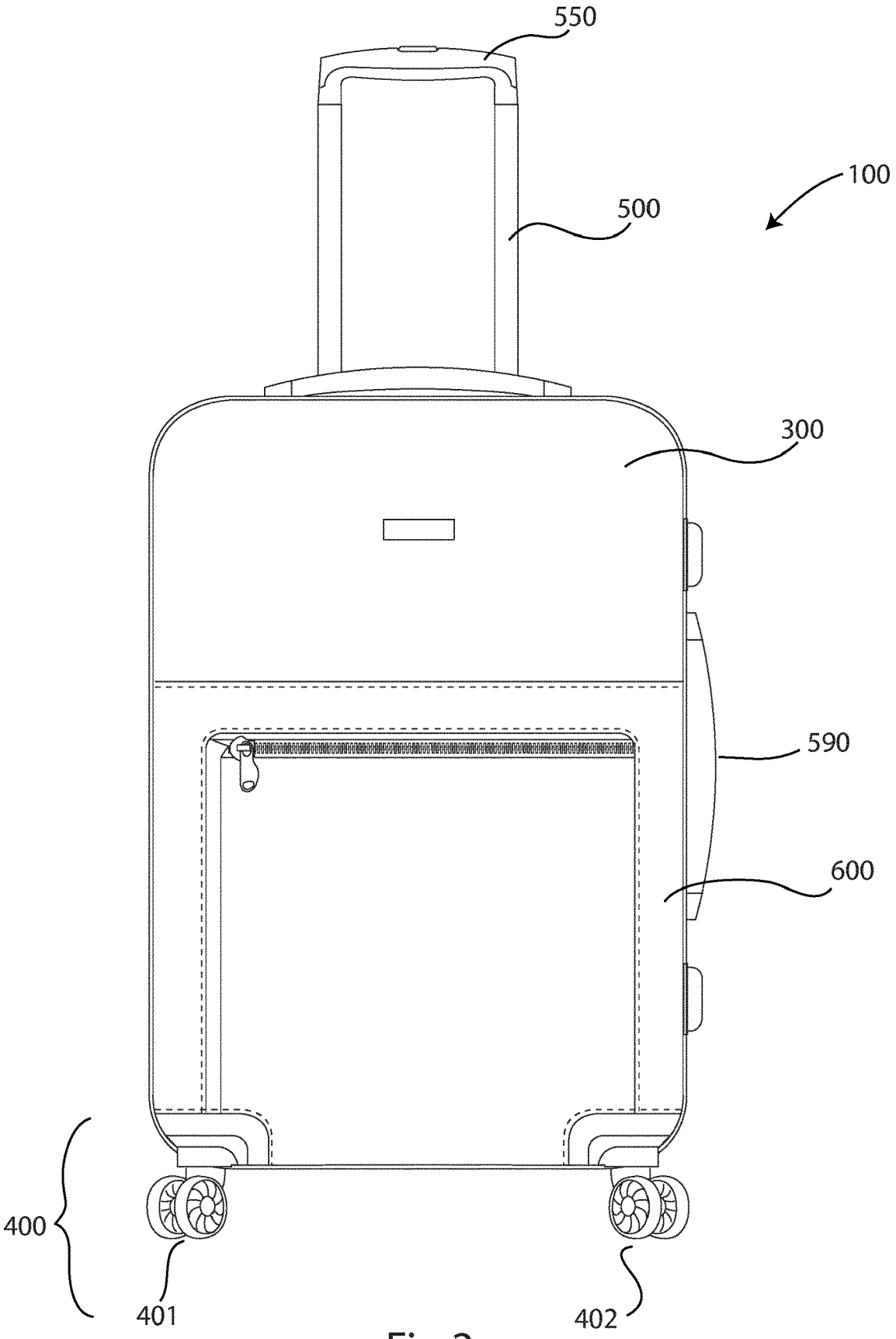
FIG. 2 shows a front view of the suitcase of FIG. 1.
Figure 3:
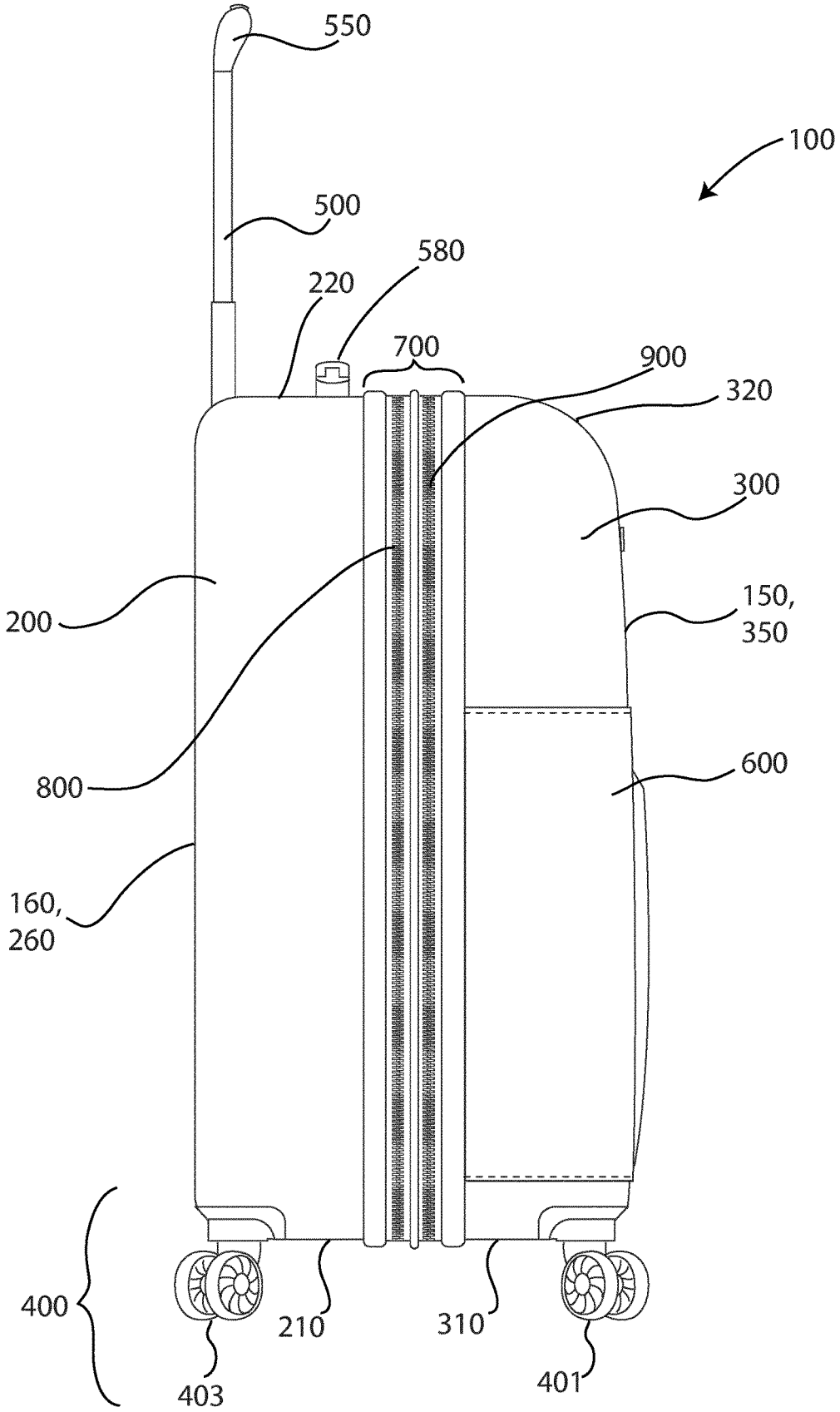
FIG. 3 shows a side view of the suitcase of FIGS. 1 and 2.

An article of luggage, specifically a suitcase 100, in accordance with an embodiment of the present disclosure is shown in FIG. 1.

The suitcase 100 comprises a body 200 in the form of a first moulded concave shell having an interior defining a body containment volume accessible through a body opening. The suitcase 100 further comprises a lid 300 in the form of a second moulded concave shell having an interior defining a lid containment volume accessible through a lid opening. The body 200 may be hingedly attached to the lid 300 using a hinge as is known in the art.

The suitcase 100 may further comprise a wheel assembly 400 and a handle assembly 500.

The suitcase 100 also includes a fabric panel 600 mounted on an exterior of the lid 300.

The suitcase 100 further comprises a zip fastening assembly 700.

The zip fastening assembly 700 may comprise a primary zip fastening 800 and a secondary zip fastening 900. The primary zip fastening 800 may serve a purpose of enabling the body 200 and the lid 300 to be mutually connected in order that the suitcase 100 may be securely retained in its closed configuration.

The secondary zip fastening 900 may serve a purpose of enabling a user to deploy a gusset in order to provide expansion capacity within the suitcase 100, as is known in the art. In an undeployed configuration of the gusset, the secondary zip fastening 900 is closed using one or more secondary zip fastening sliders such that the gusset is retained within an interior volume of the suitcase 100. In a deployed configuration of the gusset, the secondary zip fastening 900 is open (using the one or more secondary zip fastening sliders) such that, with the primary zip fastening 800 also closed, the gusset enables the lid 300 and body 200 to be spaced apart by a distance equivalent to a width of the gusset. The gusset may be of flexible but rugged fabric.

The suitcase 100 may have a standing orientation in which the suitcase 100 may stand when in its closed configuration, as shown in FIG. 1.

In the standing orientation shown in FIG. 1, a front panel 150 of the suitcase 100 is formed from a major panel 350 of the lid 300 and a rear panel 160 of the suitcase (hidden from view in FIG. 1) is formed from a major panel 260 of the body 200.

Sides of the body 200 may extend away from the major panel 260 so as to face upwards, downwards, leftwards and rightwards in the orientation of FIG. 1, as explained further below. Similarly, sides of the lid 300 may extend away from the major panel 350 so as to face upwards, downwards, leftwards and rightwards in the orientation of FIG. 1, again as explained further below.

Figure 5:
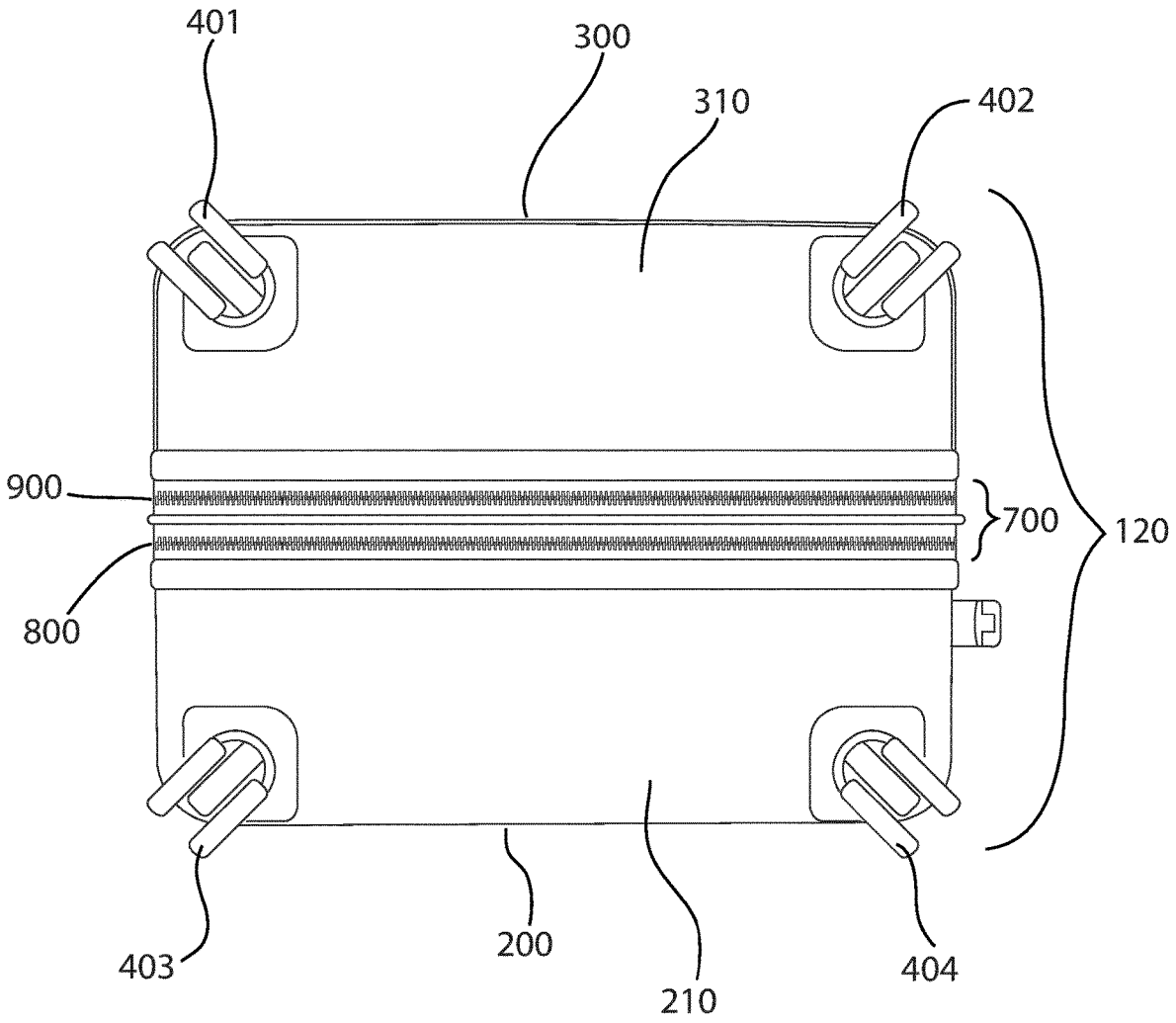
FIG. 5 shows a bottom view of the suitcase of FIGS. 1 to 5.

Viewed from the orientation of FIG. 1, a downward facing side 310 of the lid 300 and a downward facing side 210 of the body 200 may together provide a bottom surface 110 of the suitcase 100, shown most clearly in FIG. 5. The bottom surface 110 may sit substantially in a bottom plane.

Figure 4:
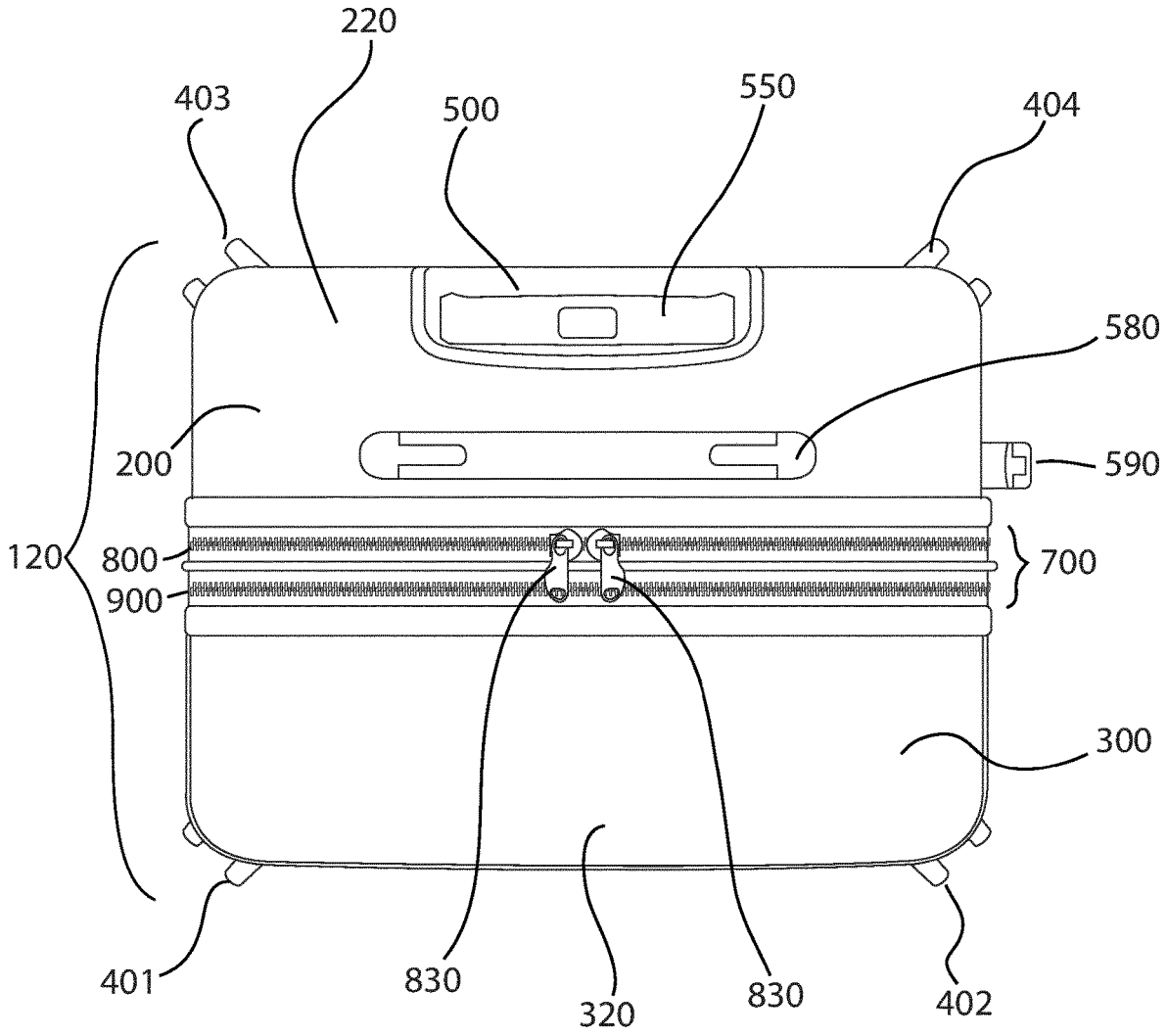
FIG. 4 shows a top view of the suitcase of FIGS. 1 to 3.

Again viewed from the orientation of FIG. 1, an upward facing side 320 of the lid 300 and an upward facing side 220 of the body 200 may together provide a top surface 120 of the suitcase 100, shown most clearly in FIG. 4. The top surface 120 may sit substantially in a top plane.

Again viewed from the orientation of FIG. 1, a left facing side 330 of the lid 300 and a left facing side 230 of the body 200 may together provide a left surface 130 of the suitcase 100. Similarly, although hidden from view in FIG. 1, a right facing side 340 of the lid 300 and a right facing side 240 of the body 200 may together provide a right surface 140 of the suitcase 100.

The body 200 may have an opening bounded by a perimeter defined by edges of the downward facing side 210, the left facing side 230, the upward facing side 220 and the right facing side of the body 200 that face away from the major panel 250.

Similarly, the lid 300 may have an opening bounded by a perimeter defined by edges of the downward facing side 310, the left facing side 330, the upward facing side 320 and the right facing side of the lid 300 that face away from the major panel 350.

The opening 290 of the body 200 and the opening 390 of the lid 300 may correspond. In this way, when the lid 300 is hinged closed with respect to the body 200, the lid opening 390 may coincide with the body opening 290. Further, it may be that the body opening 290 and the lid opening 390 have a corresponding tongue and groove arrangement, or similar, which acts to retain align and maintain mutual correspondence of the body opening 290 with the lid opening 390 (assuming that the gusset is undeployed).

The wheel assembly 400 may comprise four wheel sets 401, 402, 403, 404, one at each corner of the bottom surface 110 of the suitcase 100, perhaps most clearly illustrated from the perspective of FIG. 5. Each wheel set may comprise a pair of wheels mounted in parallel on an axle. The wheels may be rotatable not only about the axle but also the axle may be rotationally mounted to the bottom surface of the suitcase to facilitate rotation of the wheels about an axis of rotation that is vertical in the standing orientation of the suitcase 100, as shown in FIG. 1.

The handle assembly 500 may be of a telescopic arrangement as is known in the art. In this way, the handle assembly 500 may have an extended configuration and a contracted configuration. The handle assembly 500 may comprise a handle element 550 configured to serve as a handle by which the user may manipulate the suitcase 100.

In the contracted configuration (not shown), the handle assembly 500 may be largely enclosed within a cavity in the body 200 that extends at least part of a length of the body 200. The cavity may be largely accommodated within the rear panel 160 of the suitcase and largely parallel to an exterior face of the rear panel 160.

In the extended configuration (as shown), the handle assembly 500 projects out from the cavity above a top surface 120 of the suitcase 100 and extends such a that height of the handle element 550 may be located at a distance from the suitcase 10 that is comfortable for an average user to tow the suitcase along a surface (floor) wherein at least some of the wheel sets 401, 402, 403, 404 of the wheel assembly 400 are in contact with the said surface (floor).

The suitcase 100 may further comprise one or more secondary handles such as a fixed (non-telescopic) top handle 580 on the top surface 120 of the suitcase and a side handle 590 on a side surface such as the right surface 140 of the suitcase 100. The fixed top handle 580 and the side handle 590 are both visible in FIG. 4.

In this way, the user has a number of choices of handle for manipulating the suitcase 100 in a number of orientations and in a number of situations (towing, carrying in a landscape orientation and carrying in a portrait orientation).

Returning to the zip fastening assembly 700, the primary zip fastening 800 may comprise first and second zip tapes mutually connectable and disconnectable via one or more primary zip fastening sliders 830.

The first zip tape may be fastened to an external face of the lid 300 in a region where the first zip tape overlays the external face of the lid 300 around a perimeter of the lid opening 390. The first zip tape may be fastened in this manner using a stitching operation that is capable of stitching to the hard moulded material of the lid 300, for example, machine stitching.

The second zip tape may be fastened to an external face of the body 200 in a region where the second zip tape overlays the external face of the body 200 around a perimeter of the body opening 390. The second zip tape may be fastened in this manner using a stitching operation that is capable of stitching to the hard moulded material of the body 200, for example, machine stitching.

The secondary zip fastening 900 and gusset may be incorporated into the second zip tape of the primary zip fastening 800. In this way, the entire zip fastening assembly 700 may be manufactured independently and may be attached to the lid 300 and the body 200 by a single attachment operation of the first zip tape to the lid 300 and by a single attachment operation of the second zip tape to the body 200.

Figure 8:
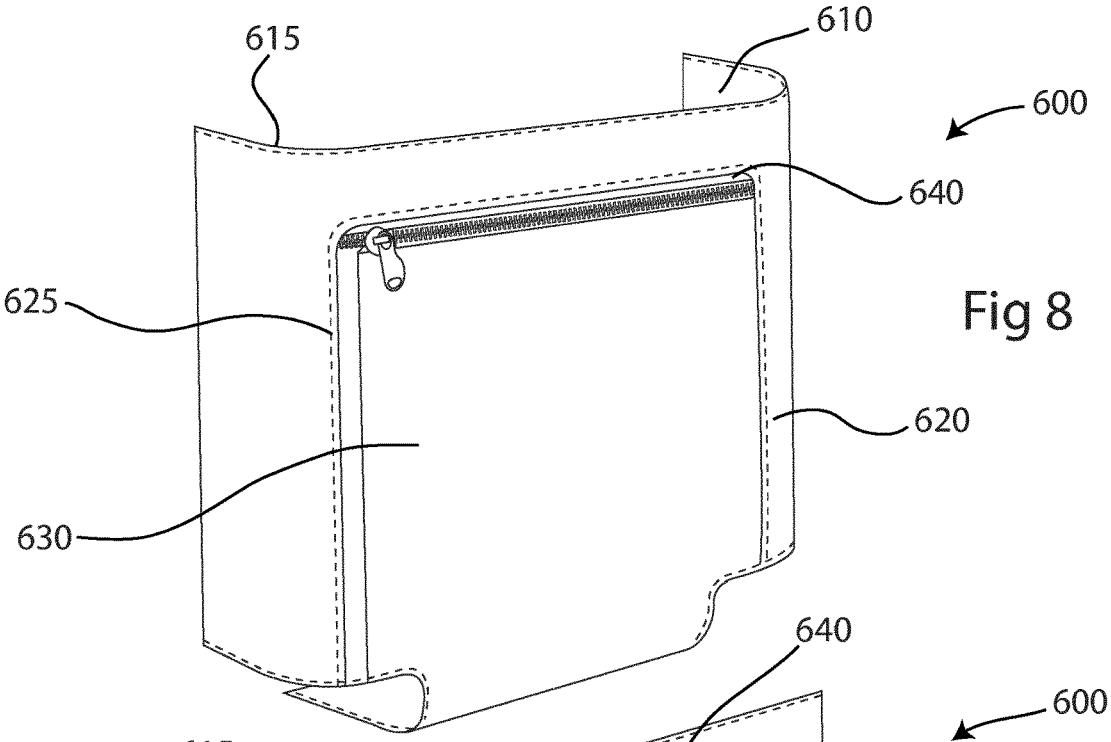
FIG. 8 shows the fabric panel of the first embodiment in isolation from other features of the article of luggage.

Referring to FIG. 8, the fabric panel 600 comprises an inner fabric sheet 610 and an outer fabric sheet 620 fastened to the inner fabric sheet 610 using fabric panel stitching 615. A pocket 630 is provided within a volume bounded within the inner and outer fabric sheets 610, 620. Secondary stitching 625 may be provided such that the volume of the pocket is smaller than the total volume between the inner and outer fabric sheets 610, 620. The pocket 630 may be accessible via a pocket zip fastening 640.

The fabric panel stitching 615, 620, shown in FIG. 8, serves a purpose of fastening together the inner and outer sheets 610, 620. The fabric panel stitching 615, 620 does not serve a purpose of fastening the fabric panel 600 to the lid 300.

Figure 9:
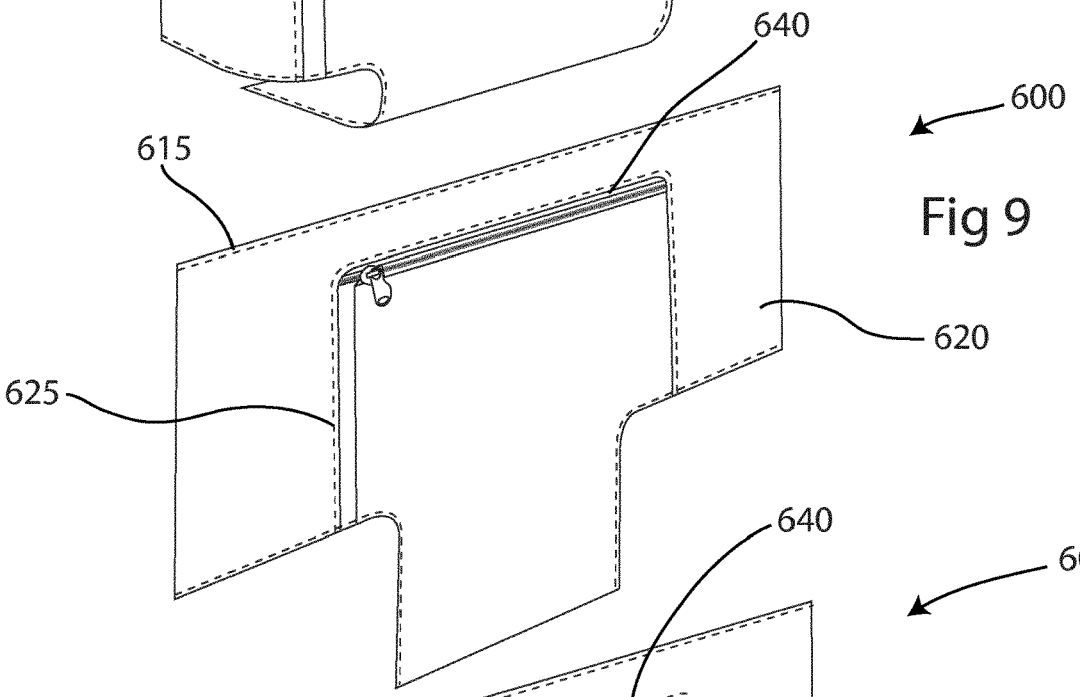
FIG. 9 shows the fabric panel of FIG. 8 in an unfolded configuration.

FIG. 9 shows the fabric panel of FIG. 8 in a planar configuration in which it may be manufactured prior to being formed into a three dimensional shape for attachment to the lid 300. In this way, the fabric panel 600 may be manufactured by overlaying the inner and outer sheets in a planar arrangement and stitching them together in that planar arrangement, before adopting a three dimensional configuration (as shown in FIG. 8) in which the fabric panel 600 may be fastened to the lid 300.

The fabric panel 600 may be dimensioned such that, when overlaid with respect to the lid 300 of the suitcase, at least some of its perimeter extends to at least some of the perimeter of the lid 300. In this way, attachment of the fabric panel 600 may be achieved using the same fastening as is used for fastening the first zip tape to the lid body 200. This avoids a need to adopt additional fastening techniques.

In other words, in an area surrounding an opening of the lid, a portion of the lid 300 may be overlaid with a portion of the first zip tape and a portion of the fabric panel 600. In this way, where the fastening is a stitching, a single stitching operation may be used to fasten all three layers together. This enables a manufacturing process with no additional fastening step to facilitate attachment of the fabric panel 600 than that already employed to facilitate attachment of the zip assembly 700. Put another way, the manufacturing step that facilitates attachment of the first zip tape to the lid 300 also (and simultaneously) serves the purpose of attaching the fabric panel 600 to the lid 300.

Alternatively, it may be that the fabric panel 600 is stitched to the first zip tape in a first operation such that the fabric panel 600 and first zip tape are brought to the lid 300 preassembled and then the preassembly is fastened to the lid 300 in exactly the same manner as the zip tape would ordinarily be fastened to the lid 300 in the a conventional hard suitcase without a fabric panel 600.

By fastening the fabric panel 600 to the lid 300 in the same fastening process as fastening the zip assembly 700 to the lid 300, the fabric panel 600 of the illustrated embodiments is attached to the lid 300 at the bottom of the fabric panel, the left of the fabric panel and the right of the fabric panel as shown in the orientation of FIG. 1 but the fabric panel is not attached to the lid 300 at the top of the fabric panel since the top of the fabric panel is not proximate the zip assembly 700 located at a top of the lid 300.

In the embodiment of FIGS. 8 and 9, the interior of the pocket 630 takes the form of an emboldened capital 'T' shape, as is clear from FIG. 9. However, as is clear from FIG. 8, once the fabric panel 600 is folded, a lower portion of the stem of the 'T' folds away from the rest of the pocket 630. Given that the fold sits against a corresponding curve in the moulded lid 300 when fastened thereto, it may be that access to the lower portion of the stem of the 'T' is impractical or largely not possible.

Figure 10:
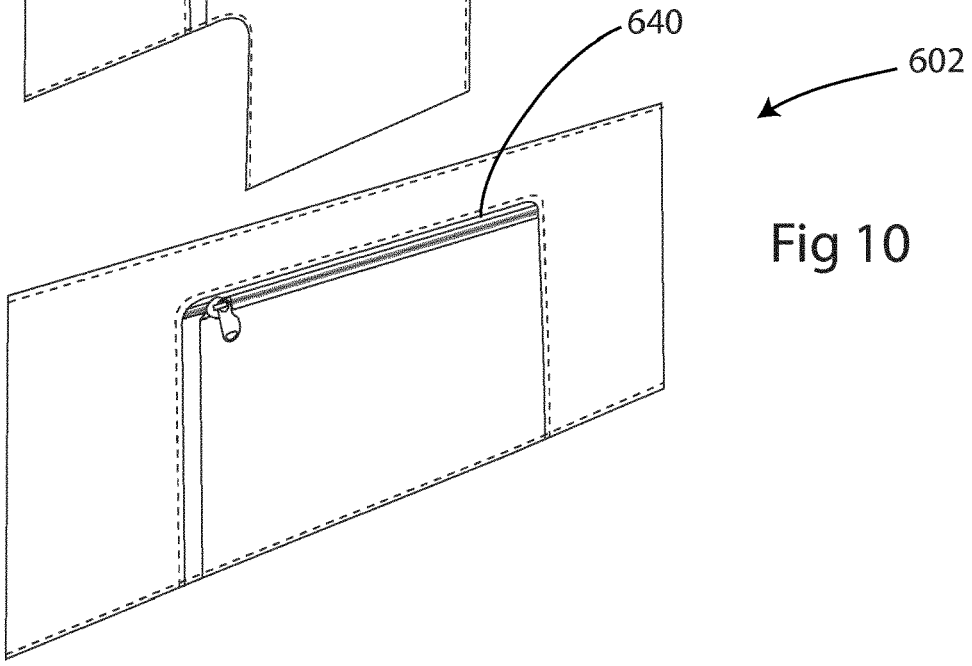
FIG. 10 shows a fabric panel of an alternative configuration to that of FIGS. 8 and 9, in an unfolded configuration.

An alternative fabric panel to that of FIGS. 8 and 9 is shown in FIG. 10. In this embodiment, the fabric panel takes the form of a rectangle rather than the form of a capital 'T'.

Figure 6:
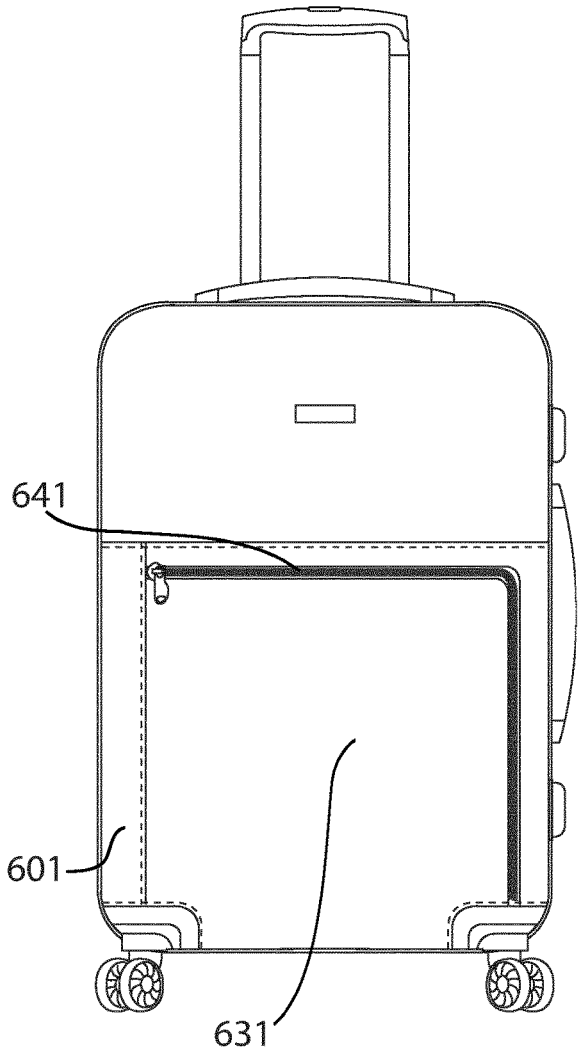
FIG. 6 shows a front view of a suitcase in accordance with a second embodiment of the disclosure.
Figure 7:
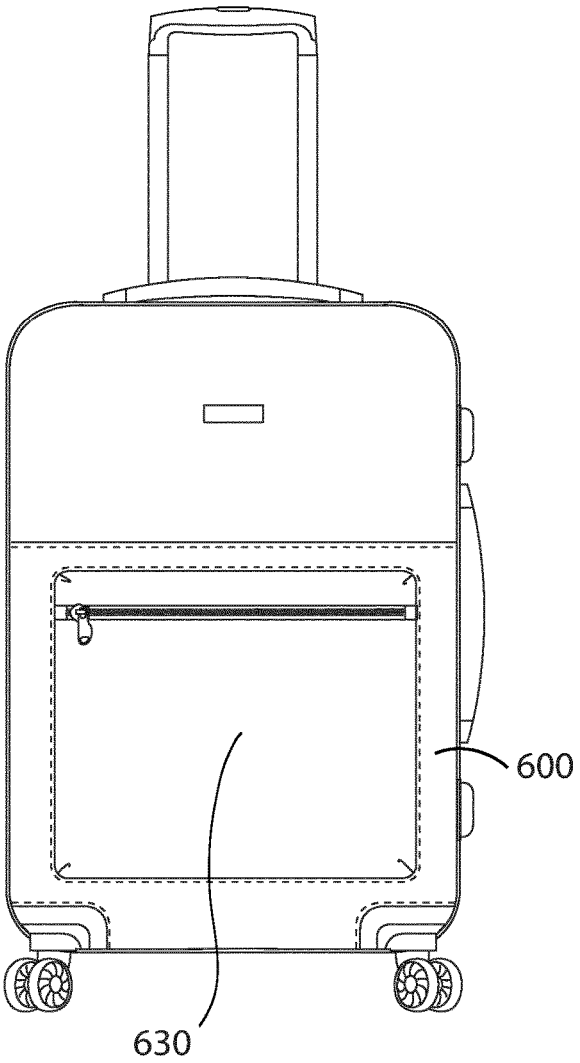
FIG. 7 is a repeat of FIG. 2 shown directly adjacent FIG. 6 such that differences between the two are readily apparent.

A further alternative fabric panel to those of FIGS. 8, 9 and 10 is shown in FIG. 6. In the FIG. 6 embodiment, the overall shape of the fabric panel 600 is 'T' shaped as in the embodiment of FIGS. 8 and 9 but the configuration of the zip fastening 641 is different. In particular, the zip fastening 640 of the FIG. 8 embodiment which has a single linear trajectory is replaced by a zip fastening 641 with two linear portions at substantially right angles to one another. In this way, the interior of the pocket is more accessible.

The moulded shell components (the body 200 and lid 300) may be of any appropriate hard moulded material such as polypropylene (PP), polycarbonate (PC), ABS, or any combination of these (e.g. ABS with PC film).

The fabric panel 600 may be of any fabric such as nylon, polyester, etc. A fabric or fabrics may be selected to have a denier and other material properties providing appropriate strength and durability for the fabric panel 600.

Stitching of the inner and outer sheets of the fabric panel 600 to one another may be conventional fabric material stitching.

Stitching of the zip assembly 700 to the body 200 and lid 300 may be in accordance with a specific stitching approach that is appropriate for stitching to the hard moulded material of the body 200 and lid 300 whilst avoiding damage thereto, through brittleness cracks, shape deformation, or any other form of damage.

Various further modifications to the illustrated embodiments are contemplated within the scope of the disclosure without departing from the scope of the claims.

For example, there may be any number of fabric panels 600 located on any appropriate part of the lid 300 or the body 200 of the suitcase 100. It is not necessarily that a fabric panel 600 must be positioned on a lower portion of the lid 300, as is shown in all of the illustrated embodiments. For example, a fabric panel 600 may be present on the body 200 instead of on the lid 300, or perhaps in addition. The terms lid 300 and body 200 are used interchangeably in the present disclosure. Effectively, the terms lid 300 and body 200 are used simply to label a first and a second moulded portion which cooperate to form a central volume within that provides a storage volume within the article of luggage 100. Hence, when the claim requires a lid having a fabric panel 600, it is not to be construed as requiring the front panel to have the fabric panel 600. It could equally be the case that the fabric panel 600 is located on the rear panel of the article of luggage 100.

Furthermore, it is not a requirement of the claimed invention that the fabric panel 600 occupies only a part of an exterior surface of the body 200 or lid 300. While the illustrated embodiments show a fabric panel 600 occupying a lower portion of the lid 300, it is also possible that the fabric panel 600 might occupy more or even all of the exterior surface of the lid 300 (or body 200). For example, whilst one of the embodiments described herein with reference to FIGS. 8 and 9 includes a fabric panel 600 having a substantially "T-shaped" form (i.e. when in its planar configuration), in other embodiments a fabric panel may be provided in another planar shape such as a rectangular form or plus/cross shape, and so forth.

Where a fabric panel 600 is provided that occupies only a part of an exterior surface of the body 200 or the lid 300, it may not necessarily be located in a lower portion of the lid 300 as shown in the illustrated embodiments. For example, it may be located in an upper portion of the lid 300, or an upper portion of the body 200 or a lower portion of the body 200.

In embodiments where the fabric panel occupies less than the entire exterior surface of the lid 300 (or body 200) it may be that the moulded lid 300 (or body 200) has a recessed portion formed as part of the moulding and sized specifically to accommodate the fabric panel 600 (not shown in the Figures). In such an embodiment, the depth of the recess may be equivalent to the thickness of the fabric panel 600 such that an exterior of the fabric panel 600 is flush with an exterior of a portion of the lid 300 in which there is no fabric panel 600. Or, expressed another way, an exterior surface of a top half of the front panel of the lid 300 may sit continuously with an exterior surface of the fabric panel 600 overlaying the bottom half of the front panel of the lid 300 without a discontinuity.

In embodiments described herein, reference is made to a pocket 630 being provided as part of the fabric panel 600. In other embodiments, two or more pockets may be provided as part of the fabric panel 600. Advantageously, as the panel 630 may selectively (i.e. depending on the shape and configuration of the panel 630) overlay different sides of the lid or body, one or more pockets can be provided on any side of the suitcase 100.

As the skilled person readily appreciates, the orientation terms used in the present disclosure are relative rather than absolute. So, for example, the terms front and back are used relatively wherein the front is relative to the back and the terms top and bottom are used relatively wherein the top is relative to the bottom. The same logic of relative rather than absolute applies to all terms that provide orientation information regarding the article of luggage.

While the illustrated embodiments comprise a handle assembly 500, a top handle 580 and a side handle 590, as the skilled person appreciates, none of these is essential to the claimed invention. Embodiments of the invention may comprise any number of handles or handle assemblies as appropriate to the application and located in accordance with the needs of the application.

The invention claimed is:

1. An article of luggage comprising:

a body in the form of a first moulded concave shell having an interior defining a body containment volume accessible through a body opening;

a lid in the form of a second moulded concave shell having an interior defining a lid containment volume accessible through a lid opening;

a primary zip fastening comprising first and second zip tapes mutually connectable and disconnectable via a zip fastening slider, wherein the first zip tape is stitched to the lid around a perimeter of the lid opening and the second zip tape is stitched to the body around a perimeter of the body opening;

a hinge between the body and the lid to enable movement of the lid relative to the body between: an open position in which the body and lid containment volumes are accessible through the body and lid openings; and a closed position in which the body and the lid openings cooperate to enable fastening of the first zip tape to the second zip tape whereby the body and lid containment portions are enclosed; and a fabric panel mounted on an exterior of the lid and stitched to the first zip tape, the fabric panel comprising a pocket having a pocket opening;

wherein the fabric panel comprises an inner fabric sheet and an outer fabric sheet fastened to the inner fabric sheet, wherein the pocket comprises a volume between the inner and outer fabric sheets; and wherein secondary stitching is provided such that the volume of the pocket is smaller than the total volume between the inner and outer fabric sheets.

2. The article of luggage of claim 1 wherein:

the fabric panel is stitched to the first zip tape using a first line of stitching; and the first zip tape is stitched to the lid using the first line of stitching.

3. The article of luggage of claim 2 wherein the fabric panel comprises first, second, third and fourth sides and wherein the first, second, third and fourth sides are stitched to at least some of the first zip tape using the first line of stitching.

4. The article of luggage of claim 1 wherein:

the fabric panel is stitched to the first zip tape using a first line of stitching; and the first zip tape is stitched to the lid using a second line of stitching.

5. The article of luggage of claim 4 wherein the fabric panel comprises first, second, third and fourth sides and wherein the first, second, third and fourth sides are stitched to at least some of the first zip tape using the second line of stitching.

6. The article of luggage of claim 1 further comprising a pocket opening zip to facilitate opening and closing of the pocket opening.

7. The article of luggage of claim 1 wherein the pocket opening is linear.

8. The article of luggage of claim 1 wherein the pocket opening comprises a first linear portion and a second linear portion substantially right angles to the first linear portion.

9. The article of luggage of claim 1 further comprising an expansion gusset having:

an undeployed condition in which the body and lid openings are in relative close proximity such that an interior volume of the article of luggage is largely bounded by the body and the lid; and a deployed configuration in which the body and lid are spaced apart by the expansion guest to provide an expanded interior volume of the article of luggage.

10. The article of luggage of claim 9 wherein the expansion gusset comprises a fabric strip that forms a part of either the first or the second zip tape.

11. The article of luggage of claim 10 wherein the expansion gusset comprises a secondary zip fastening wherein the secondary zip fastening is closable to provide the undeployed configuration of the expansion gusset and is openable to provide the deployed configuration of the expansion gusset.

12. The article of luggage of claim 1 wherein the article of luggage is in the form of a suitcase.

13. A method of manufacturing an article of luggage, the article of luggage comprising:

a body in the form of a first moulded concave shell having an interior defining a body containment volume accessible through a body opening;

a lid in the form of a second moulded concave shell having an interior defining a lid containment volume accessible through a lid opening;

a primary zip fastening comprising first and second zip tapes mutually connectable and disconnectable via a zip fastening slider, a hinge between the body and the lid to enable movement of the lid relative to the body between: an open position in which the body and lid containment volumes are accessible through the body and lid openings; and a closed position in which the body and the lid openings cooperate to enable fastening of the first zip tape to the second zip tape whereby the body and lid containment portions are enclosed; and a fabric panel comprising a pocket having a pocket opening;

wherein the method comprises:

stitching the first zip tape to the lid around a perimeter of the lid opening;

stitching the second zip tape to the body around a perimeter of the body opening;

stitching the fabric panel to the primary zip fastening;

wherein the fabric panel comprises an inner fabric sheet and an outer fabric sheet fastened to the inner fabric sheet, wherein the pocket comprises a volume between the inner and outer fabric sheets; and the method further comprises providing secondary stitching such that the volume of the pocket is smaller than the total volume between the inner and outer fabric sheets.

14. The method of claim 13 wherein the step of stitching the fabric panel to the primary zip fastening and the step of stitching the first zip tape to the lid around a perimeter of the lid opening is performed as a single stitching step.

* * * * *